United States Patent [19]

Contal

[11] 3,942,144

[45] Mar. 2, 1976

[54] CONTACT HOLDER FOR AN ELECTRO-MAGNETIC CONTACTOR

[75] Inventor: Maurice Contal, Paris, France

[73] Assignee: La Telemecanique Electrique, France

[22] Filed: Feb. 13, 1974

[21] Appl. No.: 433,691

[30] Foreign Application Priority Data

Jan. 19, 1973 France ..... 73.02011

[52] U.S. Cl. ..... 335/132; 335/196; 335/202

[51] Int. Cl.[2] ..... H01H 67/02

[58] Field of Search..... 335/196, 132, 202

[56] References Cited

UNITED STATES PATENTS

| | | | |
|---|---|---|---|
| 3,099,730 | 7/1963 | Tateishi | 335/202 X |
| 3,388,353 | 6/1968 | Isler | 335/132 |
| 3,544,929 | 12/1970 | DiMarco et al. | 335/132 X |
| 3,560,901 | 2/1971 | Horii et al. | 335/132 |

*Primary Examiner*—G. Harris

*Attorney, Agent, or Firm*—William A. Drucker

[57] ABSTRACT

The invention relates to a contact holder for an electromagnetic contactor or relay, the contact holder being slidably displaceable within a contactor housing by the contactor armature to guide the armature and change the contact state between movable contacts carried by the contact holder and fixed contacts carried by the housing. The contact holder comprises first and second parts formed from insulating material which are joined together, the first part being connected to the armature and provided with seatings on which movable bridge contacts are located, and are held in place by the second part. Elongate openings are formed in the first part between adjustment seatings, and isolating or anti-arcing partitions integral with the housing extend through the openings.

5 Claims, 3 Drawing Figures

CONTACT HOLDER FOR AN ELECTRO-MAGNETIC CONTACTOR

The invention relates to a contact-holder for an electromagnetic contactor of the type in which the contact holder also serves to guide the movable armature to which it is coupled.

Contact holders are known which are formed by two electrically insulating parts joined together, the first of which is connected to the movable armature and has openings intended to hold bridge contacts and their pressure springs, and the second of which holds the bridge contacts in place while sealing the openings.

Such a device is known for example, from German Offenlegungschrift No: 1,257,939.

In this known device, screws are used both to attach the armature and to join the insulating parts together, and this complicates the assembly process.

In addition, using screws which, because of the function they perform, have to be metal, makes the unit heavier and may give rise to loose connections due to creep of the portion of the material compressed by the screws.

Finally, the configuration of the contact holder does not allow the contact chambers, in which the contacts move, to be isolated from one another by continuous partitions.

The object of the invention, consequently, is to produce a contact holder which is light in weight, and the configuration of which enables the contact chambers to be completely mutually isolated. It is also an object to provide a contact holder, the construction of which best satisfies the requirements that such a component should possess, such as good temperatureresistant and anti-friction characteristics.

Finally, it is an object to make use of configurations and materials selected for other reasons in such a way that it is easier to fit auxiliary contacts, and possible readily either to identify the rating of the device or any other of its characteristics.

In accordance with the invention, this is achieved by providing, between the seatings intended to hold the contact elements, elongate openings formed in a first part, which is formed from a plastics material which will withstand arcing, into which fit insulating partitions integral with the housing, and by blocking or closing these openings by a sealing or second part formed from a plastics material having good anti-friction properties.

In accordance with an additional feature, the second or sealing part is attached to the first part at a number of points by elastic or resilient deformation, and has a guiding rib or groove which cooperates with a complementary recess or member on the housing.

This arrangement firstly ensures uniform support for the webs or limbs of the first part, which tends to prevent them from distorting, and secondly, it provides a guide point which is remote from areas exposed to thermal shocks.

In accordance with a further arrangement, the second or sealing part has, on at least one side, an extension parallel to the openings which fits into a corresponding extension on the first part, each of the extensions being fitted with the moving parts of auxiliary contacts.

This arrangement enables the contact holder to be used as a support for the moving parts of auxiliary contacts, the fixed parts of which are mounted beforehand on a horizontal insulating partition integral with the housing.

Finally, in accordance with an advantageous feature, the second or sealing part is accessible from the outside of the device or housing, carries a connecting lug for a detachable auxiliary contact, and is coloured or otherwise marked to indicate certain characteristics of the device.

In order that the invention may be more readily understood, one embodiment thereof will now be described with reference to the accompanying drawings, in which.

Figure 1:
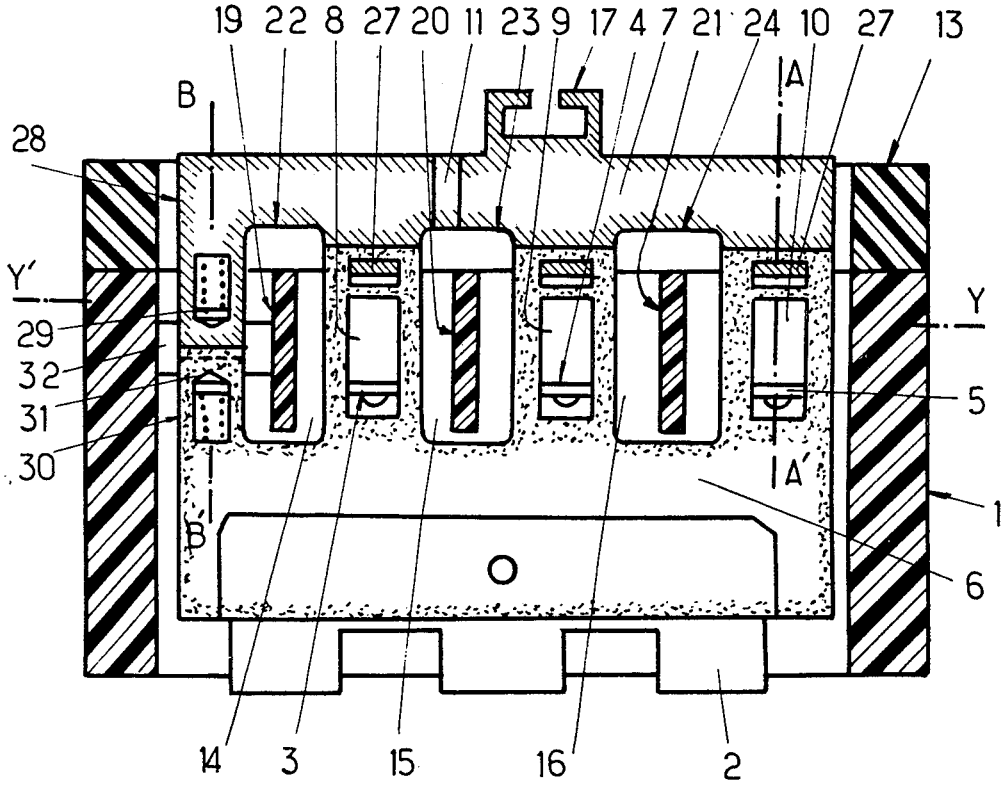
FIG. 1 shows, in partial section along the line XX′ of FIG. 2, the upper part of an electro-magnetic contactor.
Figure 2:
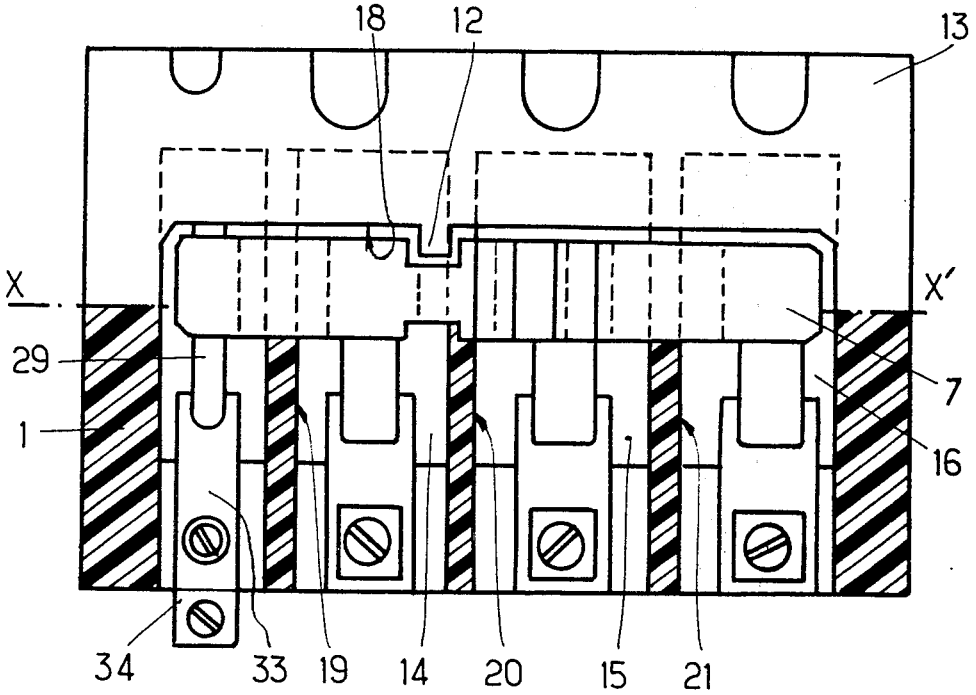
FIG. 2 shows, in partial section along the line II′ of FIG. 1, a view of the electro-magnetic contactor device from above; and, FIG. 3 is a side view made up of two half-sections on the planes AA′ and BB′ of FIG. 1.

Referring to FIG. 1, there is shown in cross-section, a housing 1 of an electro-magnetic contactor or relay having a movable armature 2. This armature, the function of which is to cause movable bridge contacts 3, 4 and 5 to move (these contacts being intended to close or complete a power circuit), is coupled by any suitable means to a contact holder which is formed in a known way by joining together two parts 6 and 7 formed from an electrically insulating material, and slidably displaceable within the housing 1 by the armature.

The first part 6, which is situated at the bottom of FIG. 1 is the one which will be exposed to the effects of the arcs which are struck between the fixed and moving contacts. At the same time this part 6 is subjected to the greatest mechanical stresses since, firstly, it is directly connected to the armature, and secondly, it is subject to the tractive forces arising when the pressure springs of the moving contacts are compressed (see also the left-hand side of FIG. 3). The nature of the material which is chosen for the part 6 will thus be determined by considerations of good mechanical and thermal resistance.

Similar considerations will apply to the choice of material for forming the housing 1.

Figure 3:
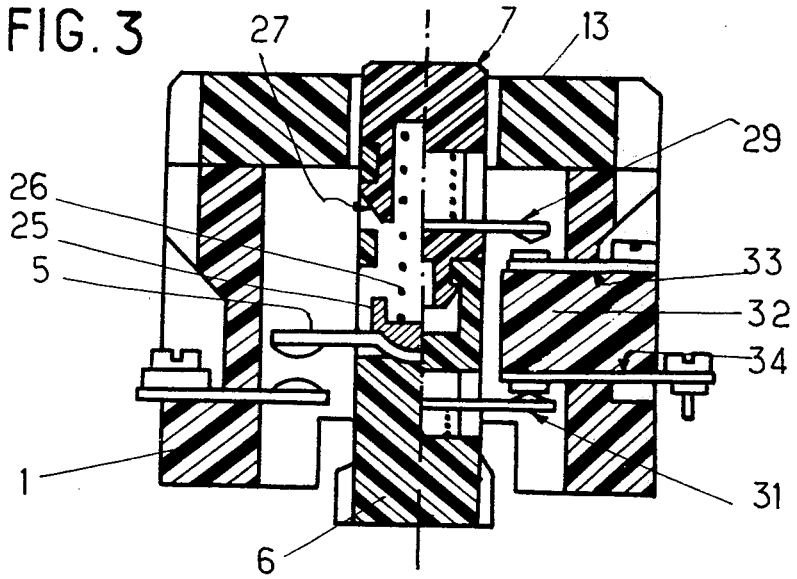

The second part 7 which forms the top of the contact holder in FIG. 1 is required to perform a number of functions:

Firstly, it seals opnings 8, 9 and 10 in the lower part 6 in which are arranged the moving bridge contacts 3, 4 and 5 respectively, this being visible in the left-hand half of FIG. 3;

Secondly, it guides the vertical movement of the contact holder, for example, by means of grooves 11 which slidably cooperate with ribs 12 provided in a cover 13 which closes off the top of arc chambers 14, 15 and 16;

Finally, it enables the control member of an auxiliary component, such as a detachable contact or a pneumatic timer (not shown), to be coupled by means of an upper lug 17 as shown in FIG. 1. To this end, an opening or slot 18 is formed in the housing cover 13 through which the lug 17 projects.

One of the problems encountered in producing a contactor is that of isolating the arc chambers 14, 15 and 16 from each other. It is only possible for the isolation to be complete if continuous partitions separate these chambers.

Furthermore, these partitions, which are subject to intense thermal shocks, will be better able to dissipate the resultant energy if they are integral with a housing in contact with, i.e. exposed to, the exterior. An advantageous solution has been found to these problems by making the contact holder capable of being dismantled.

In effect, the contactor housing 1 contains three partitions 19, 20 and 21 which are formed integrally with the housing during moulding, and which fit into openings 22, 23 and 24 respectively in the contact holder, these openings being located between the seatings for the bridge contacts. This arrangement is obviously only possible if the upper part 7 of the contact holder can be removed, and also if it closes off the top of the said openings. It can be seen that these measures in no way prevent assembly from being mechanised, since the lower part 6, which is fitted beforehand with the elements of its moving contact assembly 5, 25 and 26 (shown in FIG. 3), is then fitted inside the housing 1, and finally accepts the top part 7 of the contact holder, which compresses the springs such as 26, and remains firmly connected to the lower part by means of a locking system formed by resilient catches such as 27.

The upper part 7 of the contact holder should therefore be made from an insulating material, the nature of which will not only enable the catches to latch or snap resiliently into place, but will also allow the groove 12 to rub or slide against the rib 11 without causing wear.

Although it is possible to associate detachable auxiliary contacts with contactors of the type described by means of the lug 17, it is frequently desired that auxiliary, normally-open and normally-closed contacts should be permanently attached to the device.

This problem is rarely solved in known devices in an efficient fashion, since the auxiliary normally-open and normally-closed contacts, which are generally close together so that the wiring pattern is clear, call for the elements of their fixed or moving contacts to be fitted after the contact holder has been placed in position.

In the device just described, advantage is taken of the fact that the contact holder is made in two parts to associate with each of these two points, the moving elements of either a normally-open or a normally-closed contact, respectively.

To this end, the upper part 7 of the contact holder has a lateral extension 28 which is equipped with a normally open auxiliary contact 29 (see FIGS. 1 and 3). The extension engages with an extension 30 on the lower part 6, the latter being in turn equipped with a normally closed auxiliary contact 31.

In this way, it is possible to equip the two parts 6 and 7 of the contact holder with their auxiliary moving contact members before assembly, and to arrange the fixed contact members 33 and 34 with which they are to cooperate on a horizontal partition 32 in the housing 1. Extensions 28 and 30 are joined together in a similar way to that used to connect together parts 6 and 7 of the contact holder and the plane of the joint in a horizontal one which extends substantially through the centre of the arc chambers. The latter arrangement enables the depth of the device to be reduced.

Finally, advantage can be taken of the fact that the upper part 7 of the contact holder is visible and removable to colour it or to place markings on it which refer to some significant characteristic of the device.

I claim:

1. A contact holder intended to move in a housing of an electro-magnetic contactor, the contact holder comprising two insulating parts which are joined together, the first part being connectable to a movable armature, and containing seatings intended to hold bridge contacts and their pressure springs, and the second part holding the bridge contacts in place by closing the seatings, characterised in that the first part is made of a material which will withstand arcing, and elongate openings are formed in the first part between the seatings intended to hold the contact elements, into which openings fit isolating partitions integral with the housing and in that these openings are blocked by the second part, which is formed from a plastics material having good antifrictional properties so as to serve as a guide.

2. A contact holder according to claim 1, characterised in that the second part is fixed to the first part at a plurality of points by the resilient deformation of catches, and contains a guide groove which cooperates with complementary members integral with the housing.

3. A contact holder according to claim 1, characterized in that the second part has, on at least one side, a lateral extension parallel to the openings which fits into a corresponding extension of the first part, each of these extensions being provided with movable members of auxiliary contacts.

4. A contact holder according to claim 1 characterised in that the second part is accessible from outside the contactor housing, carries a connecting lug, and carries indications to signify certain characteristics of the contactor.

5. A contact holder according to claim 2, characerised in that the second part is accessible from outside the contactor housing, carries a connecting lug, and carries indications to signify certain characteristics of the contactor.

* * * * *